United States Patent [19]

Nakagawa et al.

[11] 4,192,402

[45] Mar. 11, 1980

[54] MUFFLER FOR INTERNAL COMBUSTION ENGINES

[75] Inventors: Takashi Nakagawa, Tokorozawa; Tadashi Sugiuchi, Niiza; Kanau Iwashita, Tokyo; Masaaki Uchida, Kawagoe, all of Japan

[73] Assignee: Honda Giken Kogyo Kabushiki Kaisha, Tokyo, Japan

[21] Appl. No.: 908,905

[22] Filed: May 23, 1978

[30] Foreign Application Priority Data

| | | | |
|---|---|---|---|
| May 27, 1977 | [JP] | Japan | 52-61841 |
| May 27, 1977 | [JP] | Japan | 52-61842 |
| Jun. 6, 1977 | [JP] | Japan | 52-66391 |

[51] Int. Cl.[2] ..... F01N 1/24

[52] U.S. Cl. ..... 181/256; 181/269; 181/272

[58] Field of Search ..... 181/231, 232, 240, 243, 181/264–282, 256

[56] References Cited

U.S. PATENT DOCUMENTS

| | | | |
|---|---|---|---|
| 1,839,192 | 1/1932 | Baits | 181/272 |
| 2,189,424 | 2/1940 | Leadbetter | 181/256 |
| 2,864,235 | 12/1958 | Paris et al. | 181/255 |
| 4,108,276 | 8/1978 | Hall et al. | 181/272 |

*Primary Examiner*—C. T. Hix
*Assistant Examiner*—Benjamin R. Fuller
*Attorney, Agent, or Firm*—Irving M. Weiner; Pamela S. Burt

[57] ABSTRACT

A muffler having a sealed diffusion chamber provided at its front end with an inlet port of a cross section smaller than that of the diffusion chamber. Within the diffusion chamber there is an outlet pipe having a closed front end disposed a fixed distance from the inlet port. The rear end of the outlet pipe communicates with the atmosphere. The walls of the outlet pipe are perforated to permit communication between the diffusion chamber and the interior of the outlet pipe.

22 Claims, 22 Drawing Figures

MUFFLER FOR INTERNAL COMBUSTION ENGINES

The invention relates to mufflers for internal combustion engines for vehicles, such as motorcycles.

Particularly, the invention relates to a muffler for internal combustion engines wherein a diffusion chamber of a diameter larger than that of an exhaust inlet pipe is provided. An outlet pipe which is opposed to the end of the inlet pipe, closed at its front end and extended at its terminal end out of the diffusion chamber, is provided in the axial direction in the diffusion chamber. The outlet pipe is provided with many perforations in the wall present within the diffusion chamber to effectively eliminate exhaust sounds, or particularly noises in medium and high sound ranges and to also effectively eliminate noises in the entire range of exhaust noises in the combination with a muffler unit of a front stage. Within an expansion chamber arranged in the front stage, a plurality of communicating pipes are provided and are made to communicate with one another through curved passages so that the pipe length may be predetermined to be as long as possible within a limited space. Sound absorbing material is also fitted in the muffler.

BACKGROUND OF THE INVENTION

Exhaust noises of an internal combustion engine for vehicles, such as motorcycles, are caused by pressure waves generated by the difference between the pressure in the cylinder and that in the exhaust pipe at the moment when the exhaust valve is opened, resonant pipe sounds amplified and generated when the pressure waves reciprocate within the pipe, and gas current noises generated by the current of the exhaust gas.

The pattern of these exhaust noises is shown in FIG. 11 wherein the abscissa represents the frequency distribution in Hz, and the ordinate represents the exhaust sound level in dB. From the line A showing the actually measured values, it is seen that considerably high level exhaust noises are generated in a range from a low frequency to a high frequency.

Various types of mufflers have already been proposed and practiced for eliminating exhaust noises, viz., an expansion type muffler, resonance type muffler, sound absorption type muffler, and muffler of a type combining either two or three of these various mufflers. However, in the conventional muffler, the more complicated the structure becomes, the more gas current sounds are generated.

The above mentioned phenomenon is pronounced in the medium and high sound ranges. For example, in the expansion type muffler, the silencing effect is obtained, as shown by the line B in FIG. 11, in a range from a comparatively low sound to a partly medium sound. However, the silencing effect in a medium sound range to a high sound range is so low that there is no silencing effect at a high frequency. Therefore, the medium and high frequency components are discharged as noises of the exhaust system.

As a countermeasure to the above problem, a practically ideal silencing effect can be obtained by noting the characteristic of the expansion type muffler, i.e., the fact that it is effective to a low sound range, and combining it with means having a silencing effect in the medium and high sound ranges with the characteristic of this silencing means being predetermined as line C in FIG. 11, so that both characteristics are combined. On this basis, a means for increasing the silencing effect in the medium and high sound ranges is proposed. It is essential to increase the overlapped area and interfering area of the characteristic B of the expansion type muffler and the characteristic C of the silencing means in the medium and high sound ranges, and to improve the sound reducing effect of the silencing means.

Therefore, it is intended to reduce and silence exhaust noises as a whole by providing a sound absorbing type tail pipe in the tail part of an exhaust pipe, silencing the medium and high sound ranges with this tail pipe, and combining this with the expansion type muffler. However, it is difficult to obtain a sufficient silencing effect with a conventional sound absorbing type silencing tail pipe.

It is known that, in the conventional sound absorbing type silencing tail pipe, many perforations are provided on the peripheral wall of a part of the exhaust pipe assembled in the muffler. Sound absorbing material, such as glass wool, is mounted by winding or so on the outer periphery of the perforated part so that the medium and high frequency components propagated as longitudinal waves within the exhaust pipe may be absorbed by the sound absorbing material disposed on the perforations, and thus reduce the exhaust noise level.

However, because the conventional sound absorption type silencing tail pipe is of such structure as mentioned above, with the increase of the exhaust current velocity, the sound waves will pass through the pipe without touching the sound absorbing material outside the wall of the exhaust pipe and will be charged out into the atmosphere. Further, because the sound waves will pass through the outlet pipe, the current velocity energy of the exhaust will be discharged without being reduced. As a result, jet sounds will be generated at the open end of the tail pipe. Thus, a sufficient silencing effect can hardly be expected from the conventional sound absorption type silencing tail pipe.

This relation is shown in FIG. 10 wherein the abscissa represents the frequency in Hz, and the ordinate represents the sound attenuation in dB. The characteristic of a conventional sound absorption type silencing tail pipe is shown by line D. As line D shows, the frequency level adapted to silencing is high and the sound attenuation is low. Therefore, even if lines B and C in FIG. 11 are combined, there would be no range matching the characteristic of the expansion type muffler; the sound reduction would be low; silencing of the medium and high frequency ranges as a whole would not be sufficiently made; and no effective silencing would be expected in the entire range of exhaust noises.

In view of the foregoing, it can be said that today a muffler having good silencing effect in the entire range of exhaust noises has not yet been proposed, and such a muffler is desired.

However, when the above mentioned sound absorption type silencing tail pipe is combined with an expansion type muffler as described above, the silencing effect as a whole is improved. In the expansion type muffler, an expansion chamber of a volume larger than that of the exhaust pipe is interposed in the exhaust system; the exhaust is introduced into the expansion chamber; the sound is attenuated in the chamber; and good silencing effect in a range from the low sound range to partly medium sound range is obtained as described before. In this type of muffler, the interior of the expansion chamber is sectioned with a partition plate, and the sectioned chambers are provided in stages to increase the attenuating effect. It is known that, in such type of muffler, when the length of the communicating pipe communicating with the interior of the expansion chamber with the next stage from the expansion chamber and further with the outside atmosphere is made long, and when the volume of the expansion chamber is also predetermined properly, the silencing effect will be improved. However, because the muffler has been made smaller taking the performance into consideration from the viewpoint of the assembling space and appearance, the length of the communicating pipe cannot readily be made long enough.

Also, sound absorbing material is generally attached to the inner wall of the muffler. However, it is necessary to consider the fact that when the area of the sound absorbing material is as large as possible, the sound absorbing effect is improved. Further, because welding traces are exposed outside the muffler or the like, particularly in a motorcycle, as the exhaust system is exposed, it is desirable that weldings be minimized. In spite of these requirements, it is desirable that the sound absorbing material assembling structure and fitting work be simplified.

SUMMARY OF THE INVENTION

The invention provides a muffler device for an internal combustion engine, including a sealed diffusion chamber having an inlet port through which exhaust from the engine is introduced into the sealed diffusion chamber. An outlet pipe extends into the sealed diffusion chamber and communicates therewith through a plurality of perforations formed in the outlet pipe. The outlet pipe has a closed front end disposed a predetermined distance from and opposed to the inlet port. The outlet pipe has a rear end communicating with the atmosphere. The inlet port has a cross section that is smaller than the cross section of the sealed diffusion chamber.

An object of the invention is to provide a muffler wherein a diffusion chamber of a diameter larger than that of an exhaust inlet pipe is provided in an exhaust system; an outlet pipe closed at its front end opposite to the rear end of the inlet pipe and made to communicate at the rear end with the outside atmosphere is provided within the diffusion chamber; and a silencing tail pipe having many perforations is provided on the peripheral wall of the outlet pipe.

According to the invention, there is obtained a muffler wherein: the exhaust introduced into the diffusion chamber is forcibly diffused and divided at the front end of the outlet pipe in the exhaust advancing direction; the phenomenon of blow through with the increase of the exhaust current velocity is prevented in this part; and the sound waves are attenuated by their repeated collisions and reflections with the inner wall of the diffusion chamber and the outer wall of the porous outlet pipe, so that the silencing effect is remarkable.

According to the invention, there is obtained a muffler wherein: the exhaust is diffused and divided within a diffusion chamber to be led into an outlet pipe through perforations in the peripheral wall of the outlet pipe; the exhaust collides again with all parts within the pipe to prevent the generation of eddy currents and winding in the opening part to the atmosphere of the outlet pipe and, together with the reduction of the current velocity energy, the generation of secondary noises, such as jet sounds, in the atmosphere opening part are prevented.

Another object is to provide a muffler wherein: perforations are made in the entire periphery of the inner wall of the diffusion chamber; and sound absorbing material is provided over the entire periphery outside the perforations so that the sound wave divided at the closed front end of the outlet pipe and collided with the inner wall of the diffusion chamber is effectively absorbed by the sound absorbing material extending through the perforations to further improve the silencing effect.

Another object is to provide a muffler wherein the distance between the exhaust inlet port and the closed end of the outlet pipe assembled within the diffusion chamber, and its relation to the diameter of the inlet port, are predetermined to reduce as much as possible the ventilation resistance of the exhaust and the influence of the back pressure on the engine, so that the silencing effect is increased.

A further object is to provide a muffler wherein the relation between the diameter of the exhaust inlet port and the outside diameter of the outlet pipe is predetermined to effectively make the division of the exhaust, collision and reflection of the sound wave component and repetition thereof so that sufficient sound reduction is obtained.

A further object is to provide a muffler wherein the diffusion chamber is a cylinder of a cross section larger than that of the exhaust inlet port; and the inside diameters of the inlet port and the diffusion chamber are predetermined to effectively attenuate noises.

Another object is to provide a muffler wherein an expansion chamber is in the front stage of the silencing means, so that the silencing effect in the medium and high sound ranges may be matched with the silencing effect in the low sound range of the expansion type muffler.

A secondary object is to provide a muffler wherein at least two communicating pipes are provided in an expansion chamber in such a manner that one is made to communicate at one end with the interior of the expansion chamber, the other is extended at one end out of the chamber to communicate with the exhaust inlet port of the silencing means, and the respective communicating pipes are connected with each other at the other ends by a curved passage sectioned from the expansion chamber and formed by a hollow partition plate having a part curved in the extending direction of the connected ends.

According to the invention: the sound absorbing material holding member is mounted between plate members without requiring securing means for the holding member so that the sound absorbing material area may be fully used; the sound absorbing effect may be improved; and the effect of preventing noises from being radiated from the wall is great.

BRIEF DESCRIPTION OF THE DRAWINGS

FIG. 18 is a vertically sectioned side view of a front plate member.

FIG. 19 is an elevation of FIG. 18.

FIG. 20 is a vertically sectioned side view of a rear plate member.

FIG. 21 is an elevation of FIG. 20.

DETAILED DESCRIPTION

Figure 1:
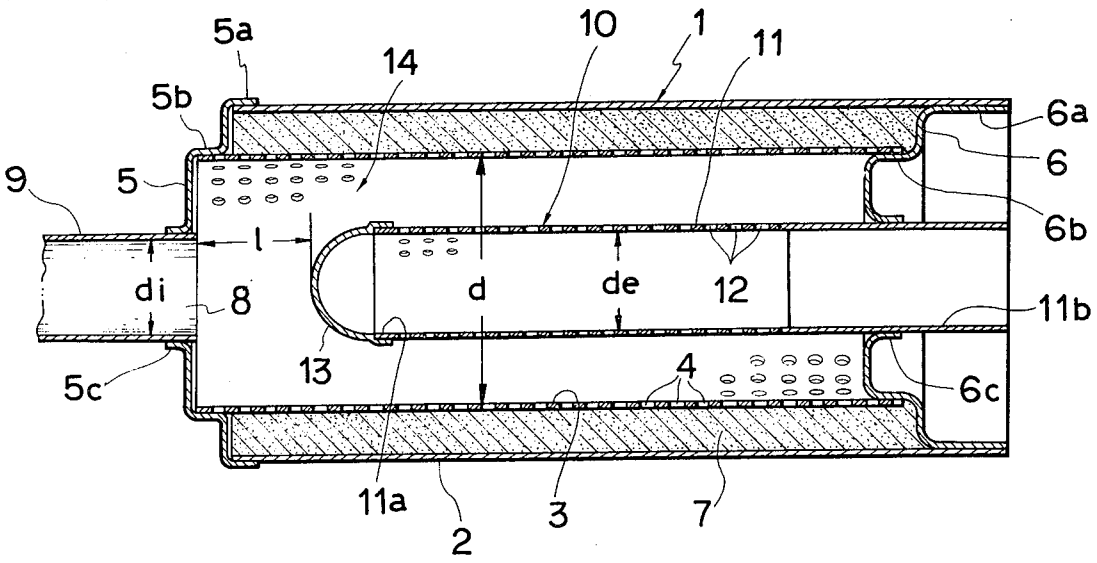
FIG. 1 is a vertically sectioned side view showing the basic structure of a muffler according to the invention.

FIG. 1 shows the basic structure of a silencing tail pipe 1 as of a muffler according to the invention. Pipe 1 consists of an outer cylinder 2 and an inner cylinder 3 fitted in it and having a diameter much smaller than cylinder 2. Cylinder 3 is provided with many small holes 4 over its entire periphery and its entire length or the greater part of it in the axial direction, and is formed from a punched plate provided with holes 4.

Cylinders 2 and 3 are closed at their front ends with steps of a front wall plate 5 having flanges 5*a* and 5*b* of large and small diameters, respectively, fitting the outer diameter parts. Cylinder 2 is closely fitted at its front end to the inner periphery of flange 5*a*, and is joined by welding or the like. Cylinder 3 is closely fitted at its front end to the inner periphery of flange 5*b*, and is joined by pressing in or the like.

Cylinders 2 and 3 are fitted at their rear ends with a rear wall plate 6 having flanges 6*a* and 6*b* of large and small diameters, respectively, formed in two steps in the outer peripheral parts. Flange 6*a* is fitted to the inner periphery of the rear end part of cylinder 2, and is joined by welding or the like. Flange part 6*b* is fitted to the inner periphery of the rear end part of cylinder 3, and is joined by pressing in or the like. The annular space between cylinders 2 and 3 is filled with sound absorbing material 7 such as glass wool. Material 7 extends into cylinder 3 through holes 4.

An exhaust inlet port 8 of a diameter much smaller than cylinder 3 is provided in the central part of plate 5, and is formed at the rear end of an exhaust inlet pipe 9. Pipe 9 is fitted at its rear end in a flanged fitting hole 5*c* made in the central part of plate 5, and is integrally connected thereto by welding or the like. Port 8 opens into the center cylinder 3. Pipe 9 is extended up-stream of the exhaust, is connected to communicate with an expansion chamber of a diameter much larger than pipe 9, and is connected to communicate with the exhaust system of the engine.

An outlet pipe 10 is provided in the axial direction within cylinder 3. The body 11 of pipe 10 is provided with many small holes 12 over its entire periphery and in the axial direction, and is formed from punched plate or the like. Its rear part 11*b* does not have small holes. In the illustration, there is adopted a structure in which a pipe having no holes is integrally welded or the like at its front end to the rear end of body 11. Part 11*b* is fitted in a flanged fitting hole 6*c* made in the center of plate 6, is made integral by welding or the like, and extends rearwardly out of plate 6. Body 11 and part 11*b* are formed coaxially, and are arranged concentrically and coaxially with port 8.

A hemispherical closing member 13 is fitted and connected to the front end part 11*a* of pipe body 11 to close body 11 at its front end. The hemispherical surface of member 13 projects forwardly toward port 8 to provide a predetermined distance 1 between the tip of member 13 and the end of port 8. Member 13 may also be conical.

A circular diffusion chamber 14, having a diameter larger than that of port 8 and fitted with pipe 10 in its center, is formed within cylinder 3.

Figure 5:
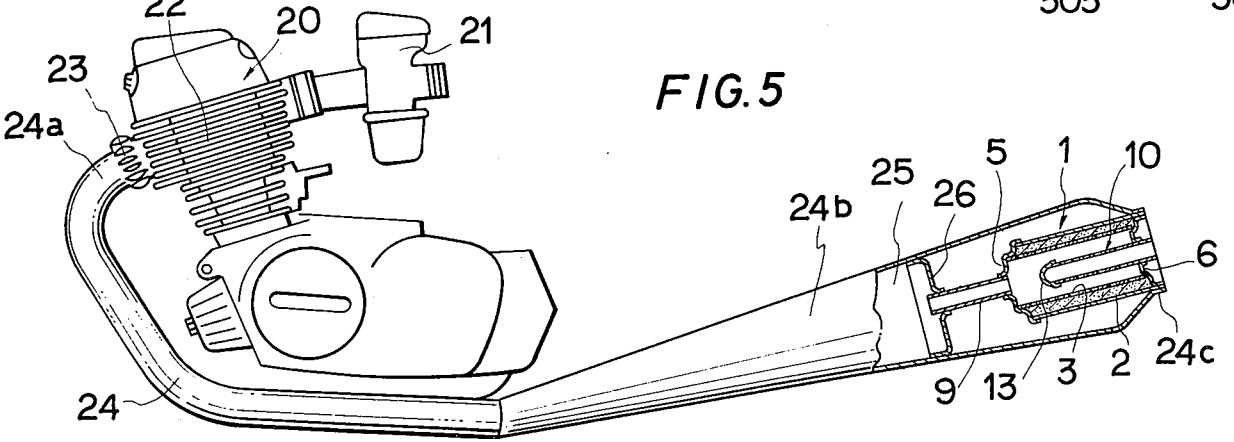
FIG. 5 is a view of an embodiment as applied as a muffler for an internal combustion engine of a motorcycle, with the essential part in section.

FIG. 5 shows an exhaust pipe of a motorcycle provided with the FIG. 1 tail pipe 1. An internal combustion engine 20 has an exhaust pipe 24 connected at its base end to an exhaust part 23 of a cylinder 22, which in turn is connected to a fuel feeding device, such as carburetor 21. The rear part of pipe 24 has an expanded part 24*b* in which an expansion chamber 25 is formed. In the tail part of expanded part 24*b*, the silencing tail pipe 1 is fitted. Pipe 10 is opened only at its rear end to communicate with the atmosphere. Pipe 9 is connected at its front end with a partition plate 26 of chamber 25 to communicate with the exhaust port of the engine. Pipe 1 has its cylinder 2 fitted at its rear end to a throttled part 24*c* at the rear end of part 24*b* by welding or the like.

The operation of the structure is explained as follows.

Noises, such as pressure waves caused by the pressure difference within pipe 24 when the exhaust valve of engine 20 is opened, resonant sounds of the pipe, and gas current sounds caused by the exhaust current, are propagated to flow as condensation waves or longitudinal waves rearwardly, i.e., toward the down-stream side together with the exhaust through pipe 24. The condensation waves are first led into chamber 25 where its low frequency component is eliminated. The low sound range component of the exhaust noises is silenced.

The sound waves in the medium and high frequency ranges which are not yet eliminated are propagated through pipe 9 to come into chamber 14. The waves led into chamber 14 from port 8 collide with the tip of the hemispherical closing member 13 facing them, and are divided on its periphery.

The sound waves collide and reflect with the inner wall of cylinder 3, collide with the outer wall of body 11, and are attenuated by the repetition of such collisions and reflections. Thus, the noise level is reduced. The collisions, reflections, and repetition thereof are made everywhere on the inner wall of chamber 14, and outer wall of pipe 10, and thereby the noises are effectively reduced. The reduced sound waves and sound waves by the collision and reflection are propagated to the interior of pipe 10 through holes 12. The same sound reducing action is also made on the inner wall of pipe 10. Thus, the sound waves discharged into the atmosphere through the rear end of pipe 10 have their frequency components effectively attenuated.

As the exhaust is introduced into chamber 14, it collides with member 13 at its front end, is divided, and is led into the outlet pipe 10 through holes 12. The exhaust is led into pipe 10 over its entire periphery, and collides again within pipe 10 in every direction. This phenomenon takes place everywhere within the pipe. Therefore, the exhaust current does not produce any eddy current and winding at the rear end of pipe 10. This prevents generation of secondary noises by eddy current or the like at the time of discharging the exhaust into the atmosphere. The current velocity energy of the exhaust is reduced by the large diameter chamber 14, and the pipe 10 closed at its front end. The generation of secondary noises, such as jet sounds produced by the quick discharge of exhaust into the atmosphere, is prevented by the above-mentioned action.

The sound wave component divided by member 13 collides with the surfaces of the material 7 extending through the small holes 12, and is absorbed by material 7. Therefore, the noise attenuating effect is further increased. Material 7 absorbs sound very well. This prevents the phenomenon known as blow through.

Unless the distance l is proper, a ventilation resistance will be produced to act as a back pressure on the engine. This is not desirable. Also, if distance l is not proper, the gas transmitted from the front stage will not be divided well by member 13, and therefore the sound reduction will be poor.

Therefore, the inside diameter of part 8 and the distance between port 8 and member 13 are formed according to the following relationship:

$$0.5 \leqq l/di \leqq 2,$$

where l is the distance between the end of port 8 and the tip of member 13, and di is the inside diameter of port 8. The ratio of l to di of $0.5 \leqq l/di \leqq 2$ is the most preferable.

Figure 7:
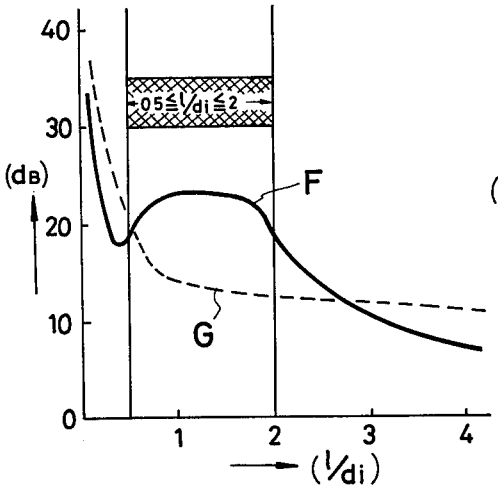
FIGS. 7, 8 and 9 are graphs of actually measured values of the respective parts according to the invention.

FIG. 7 shows actually measured values in a graph. The abscissa represents the ratio l/di, and the ordinate represents the attenuation in dB of the sound wave component. The silenced amount is shown by line F, and the back pressure level is shown by line G.

As shown by the characteristics of the lines F and G, if the ratio l/di is less than 0.5, the sound reduction will be large and a large silenced amount will be obtained, but the back pressure will be so high as to have a bad influence on the engine. When the ratio is 0.5 to 2.0, the sound reduction will be large enough, and the back pressure will be low. If the ratio exceeds 2.0, the back pressure will reduce, but the sound reduction will be too little.

If the outside diameter of pipe 10 is smaller than the inside diameter of port 8, the space between the inner wall of chamber 14 and the outer wall of pipe 10 will become so large that the sound wave component will not be divided, and no efficient collision and reflection will be made within such space. Thus, any effective attenuation of the sound wave component and reduction of sounds will be difficult to obtain.

Figure 8:
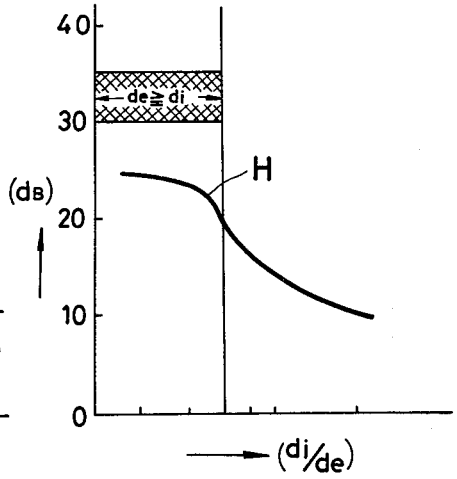

Therefore, the relation between the inside diameter of port 8 and the outside diameter of pipe 10 is made as follows:

$$de \geqq di,$$

where di is the inside diameter of port 8, and de is the outside diameter of pipe 10. FIG. 8 shows actually measured values in a graph. The abscissa represents the ratio of di/de, and the ordinate represents the attenuation in dB. As shown by line H, when the ratio of di/de is above 1, the attenuation will reduce. When the outside diameter of pipe 10 is smaller than the inside diameter of port 8, the attenuation will decrease. It is preferable that the outside diameter of pipe 10 be larger than the inside diameter of port 8.

Further, in the relation between the inside diameter of port 8 and the inside diameter of chamber 14, it is necessary by the above that the inside diameter of chamber 14 should be sufficiently larger than the inside diameter of port 8. It is necessary that the relation with the outside diameter of pipe 10 within chamber 14 should be of a proper value.

If the inside diameter of chamber 14 is large compared with the outside diameter of pipe 10, even if the relation between the outside diameter of pipe 10 and the inside diameter of port 8 and the distance between the end surfaces facing them satisfy the above relationships, any sufficient attenuation of the sound wave component and any silencing effect will be difficult to obtain. This is because, if the space between them is too large, the mentioned collisions and reflections of the sound wave components will not be made effectively. As a result, the sound reducing and silencing effect will be poor.

According to the invention, the outside diameter of pipe 10 is made half, or larger than half, the space left by removing the outside diameter of pipe 10 provided within chamber 14.

The formula, $$de \geqq (d - de)/2,$$

where de is the outside diameter of pipe 10, and d is the inside diameter of chamber 14, should be satisfied.

Figure 9:
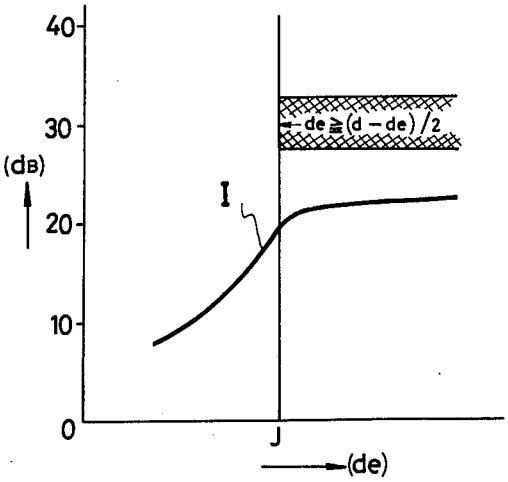

This is shown as actually measured values in the graph in FIG. 9. The abscissa represents the outside diameter de of pipe 10, and the ordinate represents the attenuation in dB. As shown by line I, in the relation with the inside diameter of chamber 14, if the outside diameter de of pipe 10 is below the point J of half the space between them, the attenuation will reduce rapidly; but, if it is above the point J, a large attenuation will be obtained with consequent efficient and effective silencing.

Modified embodiments of the invention are explained with reference to FIGS. 2 to 4.

Figure 2:
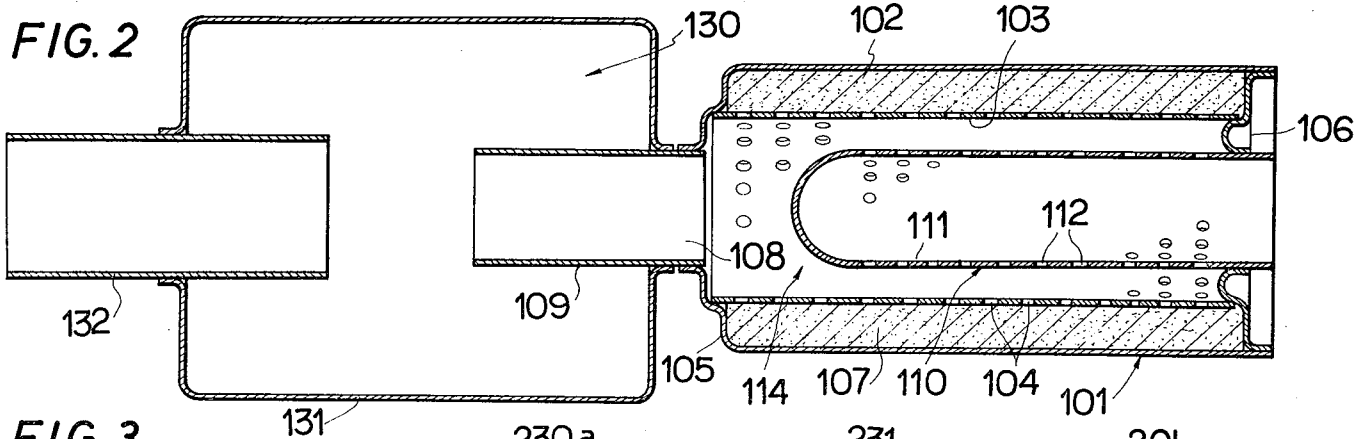
FIG. 2 is a view of another embodiment.

In FIG. 2, an expansion chamber 130 is connected to the front stage of a silencing tail pipe 101. The structure of the silencing tail pipe is the same as in FIG. 1.

The front end of pipe 101 and the rear end of a casing 131, forming chamber 130, are butted to each other, and are connected to communicate with each other through an inlet pipe 109. An engine exhaust inlet pipe 132 is connected to the front end of casing 131 so that the engine exhaust may be discharged into the atmosphere through chamber 130, pipe 109, diffusion chamber 114, and outlet pipe 110. The noises first have their low frequency components removed mainly in chamber 130, and have their medium and high frequency components attenuated and removed as much as possible by pipe 101 connected in series. The closed part at the tip of pipe 110 and the rear part having no small holes are integrally formed.

Figure 3:
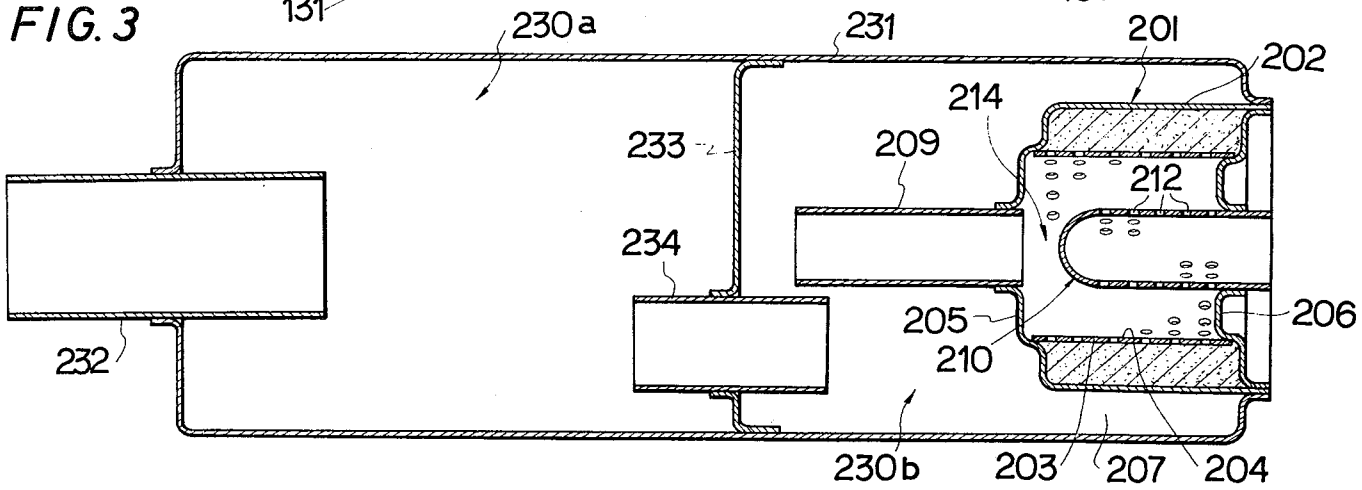
FIG. 3 is a view of a modified embodiment of FIG. 2.

In the FIG. 3 embodiment, an expansion chamber formed in an axially long casing 231 is sectioned with a partition plate 233. A front expansion chamber 230*a* is connected to communicate with the engine exhaust system through an inlet pipe 232. Plate 233 is provided with a through pipe 234 to make front and rear expansion chambers 230*a* and 230*b* communicate with each other. Chamber 230*b* is provided with a silencing tail pipe 201. Exhaust inlet pipe 209 opens within chamber 230*b*. Pipe 234 is not co-axial with pipe 209 which is located in the center.

Figure 4:
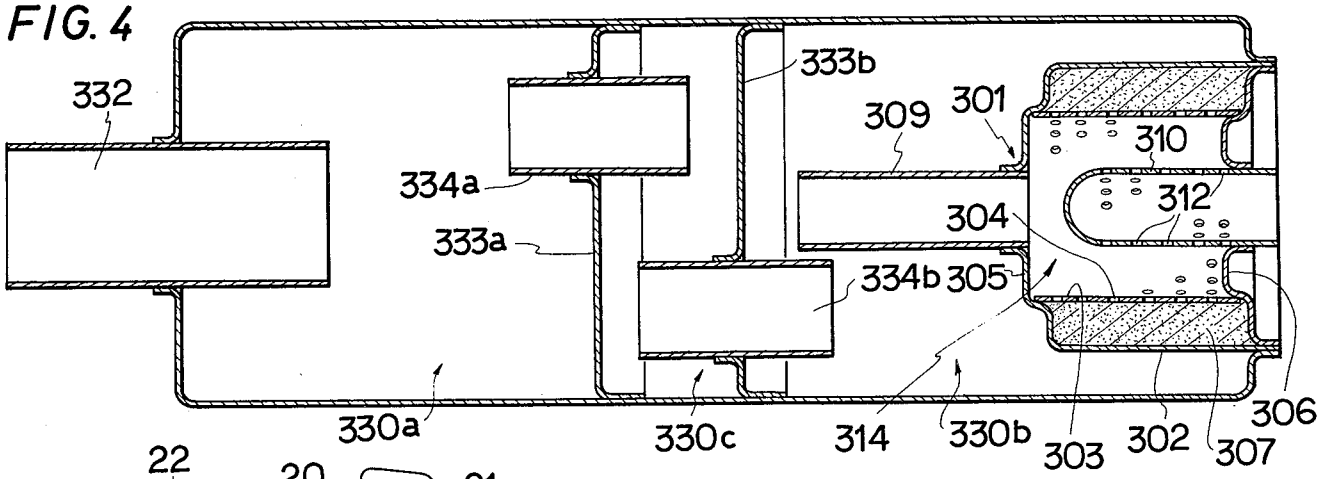
FIG. 4 is a view of a further modified embodiment.

In FIG. 4, large front and rear expansion chambers 330*a* and 330*b* formed in an axially long casing 331 are sectioned with partition plates 333*a* and 333*b* to form a small intermediate chamber 330*c* between chambers 330*a* and 330*b*. Chamber 330*a* is connected to communicate with the engine exhaust system through an inlet pipe 332. Plate 333*a* is provided with a through pipe 334*a*, and plate 333*b* is provided with a through pipe 334*b* so that chambers 330*a* and 330*b* communicate with each other via pipes 334*a* and 334*b* and chamber 330*c*. A silencing tail pipe 301 is set within chamber 330*b*.

In the above, the expansion chamber is provided in multisteps to increase mainly the attenuation of the low frequencies and the exhaust passage is made long to increase the action of the silencing tail pipe and the silencing effect as a whole.

Figure 6:
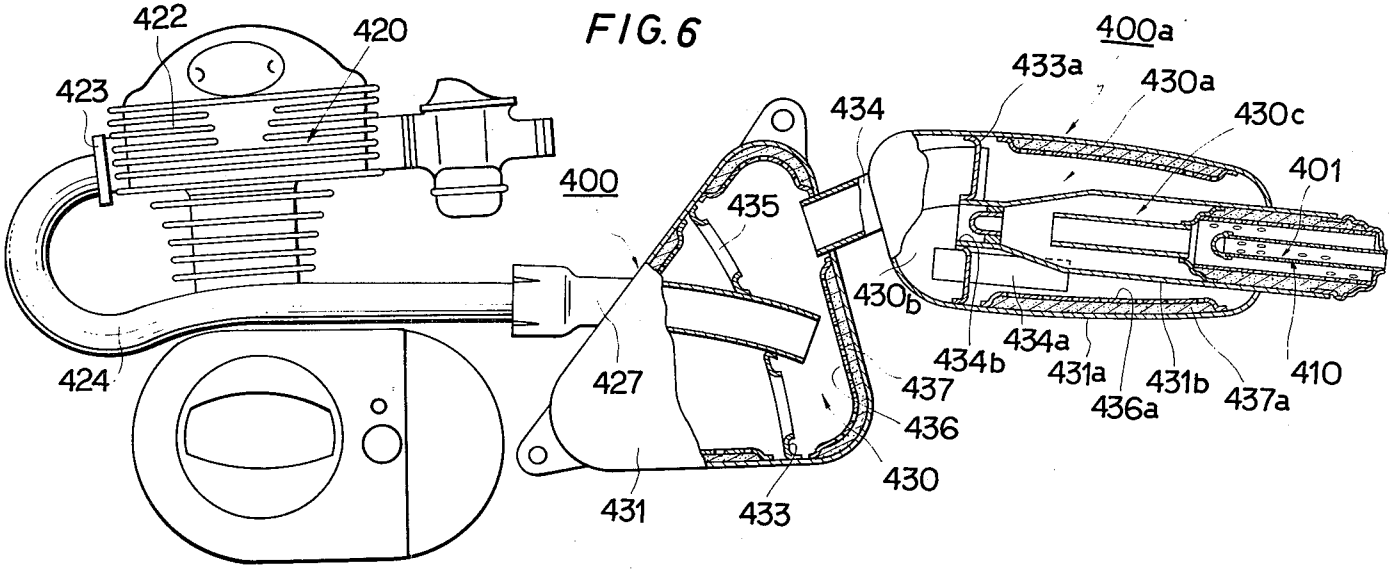
FIG. 6 is a view of a modified embodiment of FIG. 5.

FIG. 6 shows a specific embodiment of a muffler of a motorcycle. An expansion type muffler is provided in two steps, separated in the front and rear, and connected with each other through a pipe.

An exhaust pipe 424, connected to an exhaust part 423 of a cylinder of an internal combustion engine, is connected to an expansion chamber type muffler 400 through a connecting pipe 427. In the illustrated embodiment, muffler 400 has a triangular box-shaped body. Pipe 427 is inserted in its intermediate or rear part into said body, and is supported at its rear part, present within an expansion chamber 430, by a partition plate 433 having through holes 435 and curved so that its respective parts do not lie in the same flat plane. Sound absorbing material 437 is provided through a porous plate 436 on the inner wall of chamber 430. Another connecting pipe 434 is opened at its front end in a part of a case 431 of muffler 400, and is connected to communicate with the next muffler 400*a* to make its expansion chamber 430*a* and chamber 430 communicate with each other.

Chamber 430*a*, formed within a case 431*a* of muffler 400*a*, is sectioned by a partition plate 433*a* to provide a detour chamber 430*b*. Pipe 434 passes through chamber 430*b* and opens into chamber 430*a*. Chambers 430*a* and 430*b* communicate with each other through a through pipe 434*a*. Chamber 430*b* communicates with a secondary expansion chamber 430*c* provided within a case 431*b* fitted in chamber 430*a* through a through pipe part 434*b*. A silencing tail pipe 401 is provided in chamber 430*c*. Case 431*b* is also an outer cylinder of pipe 401. Sound absorbing material 437*a* is fitted through a porous plate 436*a* on the inner wall of chamber 430*a*.

Primarily the low frequency components of the exhaust noises are attenuated and silenced in chambers 430, 430*a* and 430*c*, and primarily the medium and high frequency components are attenuated and silenced in pipe 401. Materials 437 and 437*a* are provided in chambers 430 and 430*a*, respectively, to increase the sound absorbing effect. Plate 433 in the front stage is curved so that the sound waves component led into chamber 430 may irregularly reflect on the curved surface of plate 433, and the condensation waves may interfere and collide with each other to increase the attenuating effect. Thus, the attenuatable frequency band can be increased.

Figure 10:
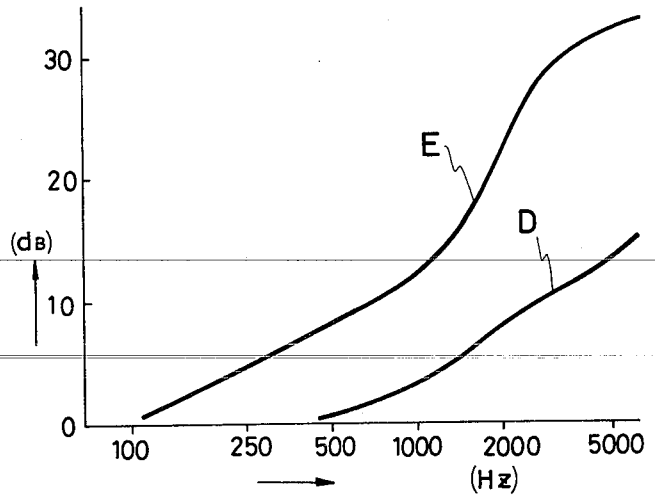
FIG. 10 is a graph of actually measured values of the invention as compared with conventional means.
Figure 11:
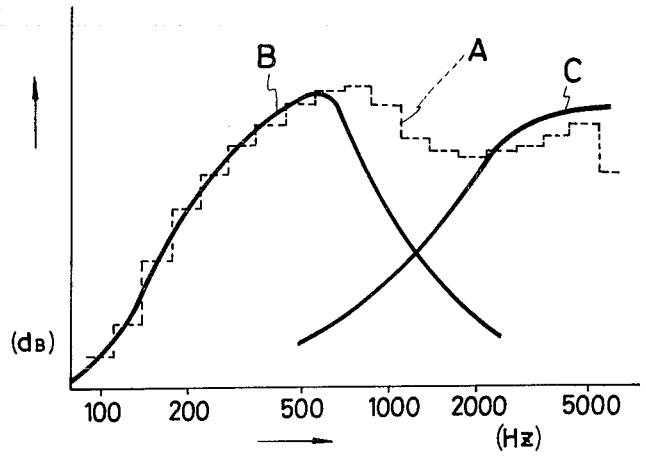
FIG. 11 is a graph showing respective characteristics and exhaust noise patterns of an expansion type muffler and the invention.

The silencing effect of the silencing tail pipe explained above as compared with a conventional one is shown in FIG. 10. Line E shows the characteristic of the silencing tail pipe according to the invention, and line D shows the characteristic of the conventional one described above. The characteristics are actually measured values. The frequency band reduced by the invention is wider than with the conventional means, and the sound reduction is also much larger than with the conventional means. There can be obtained a muffler wherein the characteristic of the expansion type muffler is increased, and the silencing tail pipe of the invention is used to enlarge the frequency range in which both match each other. Also, the sound reduction can be improved while enlarging the overlapped range of lines B and C in FIG. 11, and the exhaust noises can be silenced over the entire range.

Figure 12:
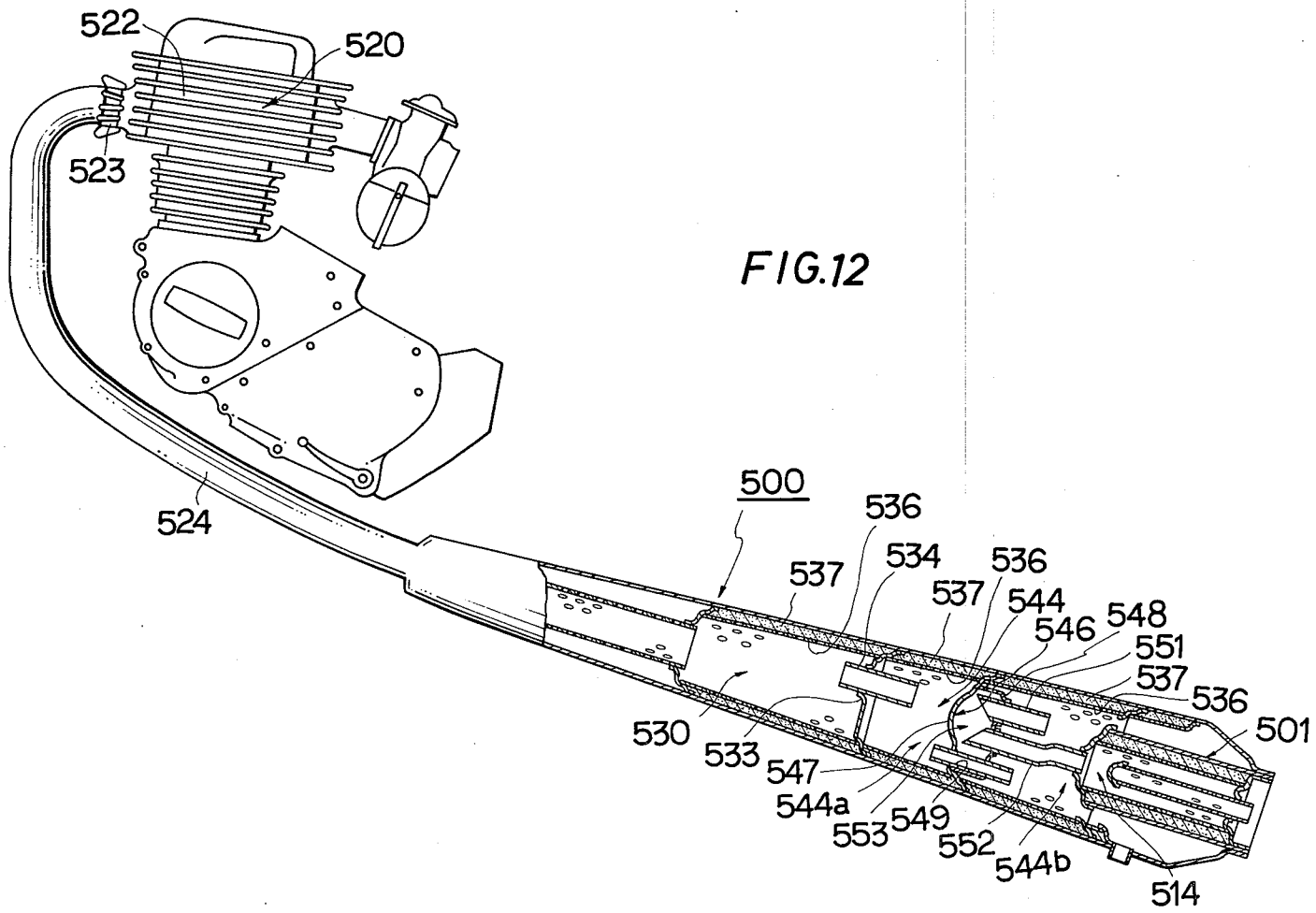
FIG. 12 is a view of an embodiment having both pipe length securing means and sound absorbing means, with the necessary part in section.

FIG. 12 shows a further embodiment wherein a muffler including a pipe length increasing means of an expansion type muffler is provided up-stream of the silencing tail pipe.

Figure 13:
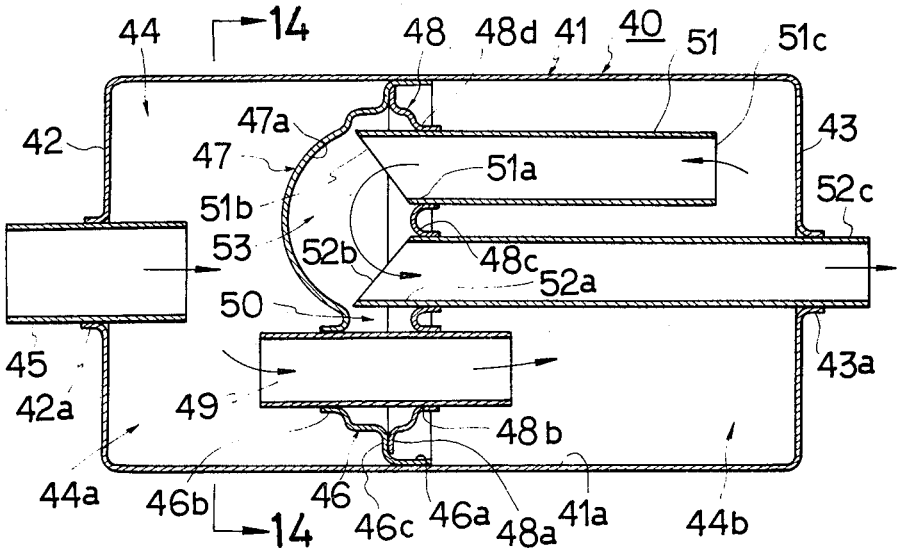
FIG. 13 is a vertically sectioned view of another embodiment.
Figure 14:
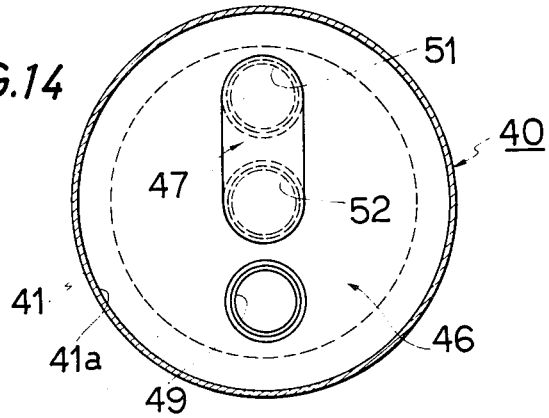
FIG. 14 is a sectioned view on line 14—14 of FIG. 13.

The details of the pipe length increasing means are shown in FIGS. 13 and 14. A muffler 40 consists of a cylindrical case 41 with front and rear wall plates 42 and 43, and an expansion chamber 44. A fitting hole provided with a fitting flange 42*a* is formed in the central part of wall 42. A connecting pipe 45 is fitted and secured in the fitting hole. Pipe 45 opens into a front expansion chamber 44*a*.

Chamber 44 is sectioned into front and rear chambers 44*a* and 44*b* by a partition plate 46 which is formed to fit the inner wall 41*a* of case 41 as shown in FIG. 14. A ring-shaped fitting flange 46*a* is formed integrally around the disk-shaped plate 46, and is welded to the inner wall of case 41. A fitting flanged hole 46*b* is formed in the lower part of plate 46. An arcuately forward expanding curved part 47 is integrally formed over the intermediate and upper parts of plate 46. The rear surface of part 47 is an arcuately curved concave surface 47*a*.

A disk-shaped supporting plate 48 is provided on the rear side of plate 46, and has the forward projected part 48*a* jointed integrally to the fitting part 46*c* of flange 46*a*. A flanged hole 48*b* is provided in the part facing hole 46*b*. A connecting pipe 49 is passed and inserted between holes 46*b* and 48*b* and is secured to the flanged holes. Chambers 44*a* and 44*b* communicate with each other through pipe 49 which is insulated from a space 50 formed between plates 46 and 48.

A first communicating pipe 51 is secured at its front part 51*a* in an upper fitting flanged hole 48*d* to face surface 47*a* at its open front end 51*b*, and is opened at its rear end 51*c* to communicate with chamber 44*b*. A second communicating pipe 52 is secured at its front part 52*a* in a lower fitting flanged hole 48*c* to face surface 47*a* at its open front end 52*b*, and is fitted at its rear end 52*c* in a fitting flanged hole 43*a* made in the central part of wall 43. Pipe 52 is connected at its rear end to the exhaust inlet pipe of the silencing tail pipe. Thus, a communicating passage or chamber 53 is formed at the front ends of pipes 51 and 52.

Pipes 51 and 52 are symmetrically diagonally cut at ends 51*b* and 52*b* present in passage 53 to be opposed to each other at said front ends. Instead of being thus diagonally cut, the pipes may be bent at the front ends symmetrically with each other to be opposed at the openings to each other.

As shown by the arrow, the exhaust enters chamber 44*a* through pipe 45. Mainly the low frequencies are attenuated by the expansion chamber effect in chamber 44*a*. The exhaust flows into chamber 44*b* through pipe 49 and is further attenuated by the action of expansion chamber 44*b*. The exhaust flows into pipe 51 and into chamber 53. The exhaust is guided by surface 47*a* to flow toward the opening of pipe 52, passes through pipe 52, and is led into the silencing tail pipe in the next stage. Because the surface in the exhaust flowing direction of chamber 53 is a curved concave surface, the gas current is guided by it to flow smoothly. Even if pipes 51 and 52 are provided so that the exhaust current may be directed in the reverse direction, the ventilation resistance and the back pressure on the engine side will be minimized.

Because pipes 51 and 52 are cut diagonally, the current of the exhaust at opening 51*b* is given a downward direction, and opening 52*b* is directed upwardly to receive the exhaust current. Because of the guiding action of surface 47*a*, the flow of the exhaust between both pipes is so smooth that the ventilation resistance is made as small as possible.

FIG. 12 shows an expansion type muffler 500 connected to an exhaust pipe 524, which in turn is connected to an exhaust part 523 of a cylinder 522 of an internal combustion engine. Muffler 500 is formed as to be larger in diameter rearwardly. Muffler 500 is sectioned with a partition plate 533 to provide a primary expansion chamber 530 and secondary expansion chamber 544 which communicate with each other via a through pipe 534. Chamber 544 is provided with front and rear chambers 544*a* and 544*b* sectioned from each other by a partition plate 546 having curved part 547 and a supporting plate 548. Chambers 544*a* and 544*b* communicate with each other via a through pipe 549. A first pipe 551, opening at its rear end in chamber 544*b*, and at its front end in a curved passage 553, is provided in the upper part of plate 548. A second pipe 552 is opened at its front end in passage 553, and is also the exhaust inlet pipe of a silencing tail pipe 501, and communicates with a diffusion chamber 514 of pipe 501 provided at the tail end of chamber 544*b*.

A porous plate 536 is used for the inner walls of chambers 530 and 544, and sound absorbing material 537 is fitted through it.

Thus, a muffler having its pipe length increased is fitted in an expansion type muffler, and is connected to a silencing tail pipe to obtain a muffler device having an excellent silencing effect.

Figure 15:
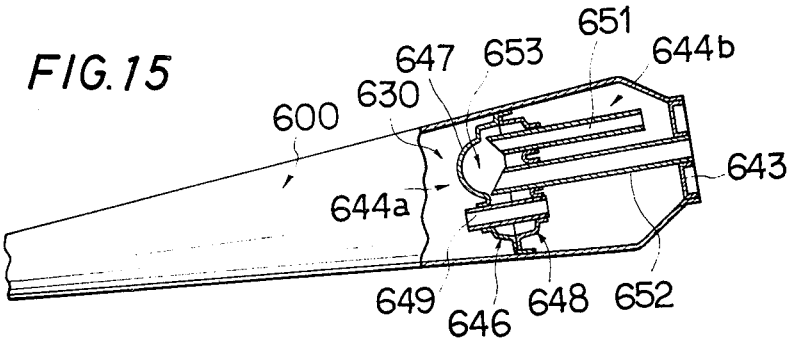
FIG. 15 is a view of an embodiment in which the device in FIG. 13 is used in the tail part of an exhaust system, with the essential part in section.

A muffler device can also be formed by using only the above mentioned muffler, as shown in FIG. 15. A muffler 600 is provided with an expansion chamber 630 which is sectioned by a partition plate 646 having a curved part 647 and a supporting plate 648. Curved passage 653 is provided between plates 646 and 648. First and second pipes 651 and 652 enter passage 653. Pipe 651 opens in a rear chamber 644*b*. Pipe 652 opens out rearwardly through a tail end plate 643. Front and rear expansion chambers 644*a* and 644*b* are connected with each other via a through pipe 649.

Thus, the pipe length increasing means can also be used for only an expansion type muffler.

When the inner wall of a muffler is provided with sound absorbing material through a porous plate, medium and high frequency components propagated as condensation waves or longitudinal waves are absorbed, and the silencing effect is improved. Even in the silencing tail pipe shown in FIG. 1, when the sound absorbing material 7 is used, the silencing effect will further improve.

As shown in FIG. 1, the structure of fitting material 7 is as follows. Cylinder 3, consisting of a cylindrical porous plate, is so formed to fit at the front and rear ends with the inside diameter of flange 5*b* and the outside diameter part 6*b*. Cylinder 2 is welded to flanges 5*a* and 6*a*, but cylinder 3 is not welded. Material 7 can be installed without welding the porous plate. In welding the porous plate to the outer plates, a welding margin is required, and it is necessary to separate the sound absorbing material from the welded part and therefore the substantial sound absorbing area of the sound absorbing material is reduced. However, according to the above, there is no such disadvantage, and the sound absorbing material can be provided on the entire surface of the inner wall except the front and rear wall plates.

FIGS. 16 to 22 show an embodiment wherein the above is applied to the inner wall of an expansion type muffler.

Figure 22:
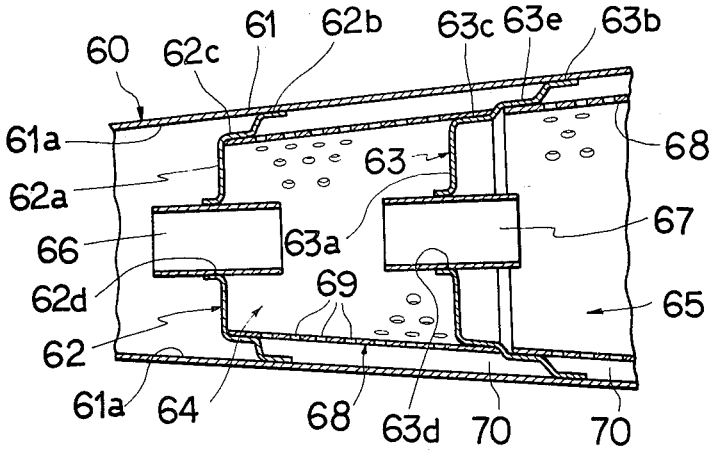
FIG. 22 is a view of the assembly as completed.

In FIG. 22, a muffler 60 has a cylindrical body 61. In the illustrated embodiment, body 61 is a tapered cylinder in which the diameter increases gradually toward the rear. Body 61 is sectioned by partition plates 62 and 63 to form expansion chambers 64 and 65.

Figure 18:
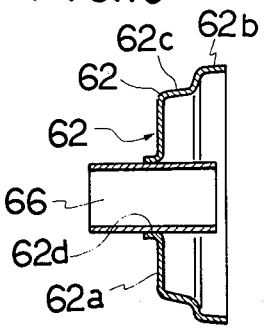
FIGS. 18 to 21 are views of component parts.
Figure 19:
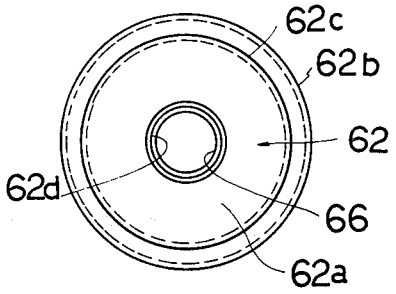

As shown in FIGS. 18 and 19, plate 62 is provided integrally with a fitting flange 62*b* in the outermost peripheral part of disk-shaped body 62*a*. Flange 62*b* has an outside diameter closely fitting a predetermined position of the tapered inner wall 61*a* of body 61, and is tapered to be along wall 61*a*. A supporting flange part 62*c* is also tapered in the form of a step concentric with flange 62*b*. A flanged hole 62*d* is made in the center of body 62*a*, and a through pipe 66 is fitted in hole 62*d* and is made integral by welding.

Figure 20:
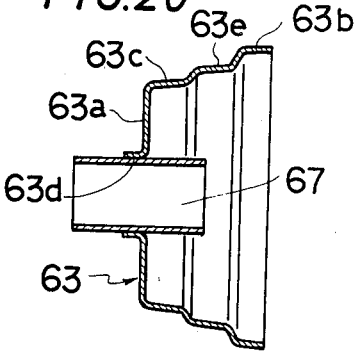
Figure 21:
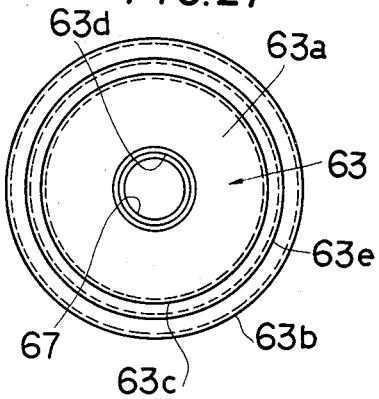

As shown in FIGS. 20 and 21, plate 63 is provided in its outermost peripheral part of disk-shaped body 63*a* with a similar flange 63*b*. A first supporting flange 63*e* in the inside diameter part of flange 63*b*, and a second supporting flange 63*c* in the inside diameter part of flange 63*e* are continuously provided as stepped. Flange 63*c* has a diameter smaller than flange 63*e* by the dimension of the thickness of a pressing member. Flanges 63*b*, 63*c* and 63*e* are continuously formed to be concentrically ring-shaped. A through pipe 67 is made integral by welding through a flanged hole 63*d* in the center part of body 63*a*.

A tubular holding member 68 is a tapered cylinder concentric with body 61, and is provided with many small holes 69 over its entire periphery. Member 68 is obtained by shaping punched plate to be tubular. Its length in the axial direction is set to fit between plates 62 and 63. Its outside diameter is set to closely fit the inside diameter of flange 62*c*. Its inside diameter is set to closely fit the outside diameter of flange 63*c*.

Sound absorbing material 70 is obtained by compressing and shaping glass wool or the like to be in the form of a cylinder or, in the illustrated embodiment, a tapered cylinder having a fixed thickness so that its outside diameter may closely fit wall 61*a* or may be somewhat larger, and its inside diameter may closely fit the outside diameter of member 68 or may be somewhat smaller.

Figure 16:
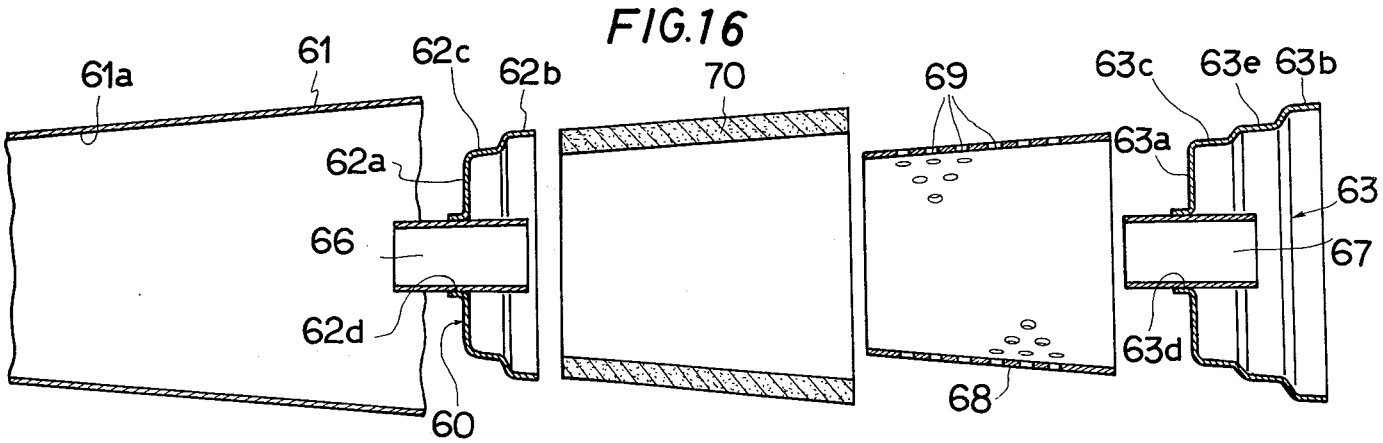
FIG. 16 is a disassembled vertically section side view showing a fitting structure for a muffler provided by the invention.
Figure 17:
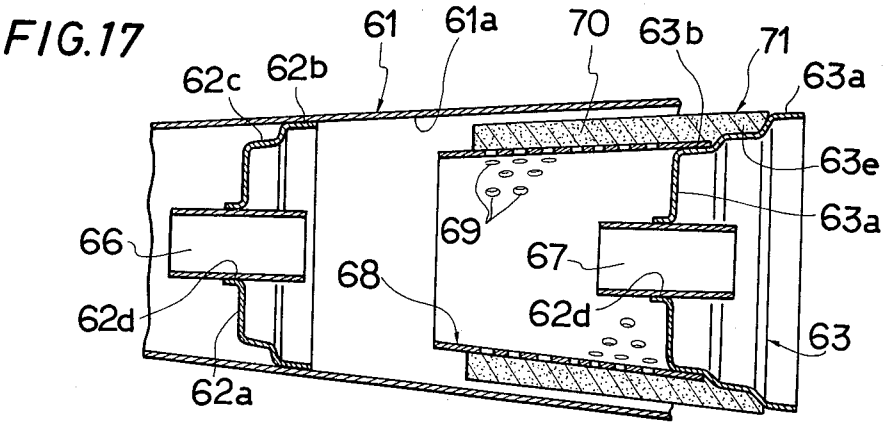
FIG. 17 is a view of FIG. 16 as assembled.

FIG. 16 shows the components disassembled and arranged in the axial direction. Plate 62 is first fitted in body 61 so that body 62*a* may be positioned in the front and is joined by spot-welding with wall 61*a* in the position in which flange 62*b* closely fits against wall 61*a*. Then member 68 is fitted and joined to flange 63*c* by spot-welding. Member 68 is then fitted with material 70 on its outer periphery. Material 70 may not be shaped as illustrated, but may be used in the form of a thick sheet to be wound on the outer periphery of member 68.

A unit 71 (FIG. 17) made by integrating plate 63, member 68, and material 70 is fitted and inserted into body 61 from the rear. Member 68 is fitted and inserted with its tip into and against flange 62*c* so that flange 63*b* may closely contact wall 61*a*. Member 68 is spot-welded to be joined integrally with plate 62. Material 70 is fitted to the inner wall of the body by member 68 between plates 62 and 63. Then, the next partition plate, holding member and sound absorbing material are fitted to the rear of plate 63 (FIG. 22) with the above procedure to use the material 70 in a multistep chamber. In this case, plate 63 will function the same as plate 62.

A procedure of first fitting the rear partition plate in the body and then fitting the holding member, sound absorbing member and front partition plate, i.e., a procedure reverse to the above, may also be adopted.

Sound absorbing material can thus be easily used in a simple structure with a minimum of welding operations, and this facilitates the mass-production of sound absorbing material type mufflers.

We claim:

1. A muffler device for an internal combustion engine, comprising:

a sealed diffusion chamber having an inlet port through which exhaust from said engine is directly introduced into said sealed diffusion chamber;

an outlet pipe extending into said sealed diffusion chamber and communicating therewith through a plurality of perforations formed in said outlet pipe;

said outlet pipe being disposed substantially concentrically and coaxially relative to said inlet port;

said outlet pipe having a front closed end disposed at a predetermined distance from and opposed to said inlet port;

said muffler being constructed to satisfy the relation $0.5 \leqq 1/di \leqq 2$, where "1" is said predetermined distance between said inlet port and said front end of said outlet pipe, and di is the diameter of said inlet port;

said muffler being further constructed to satisfy the relation $de \geqq di$, where de is the outside diameter of said outlet pipe, and di is the diameter of said inlet port; and said inlet port having a cross section that is smaller than the cross section of said sealed diffusion chamber.

2. A muffler according to claim 1, wherein:

said sealed diffusion chamber is formed with inner and outer walls;

sound absorbing material is disposed between said inner and outer walls; and said inner wall is provided with a plurality of perforations through which at least a portion of said sound absorbing material extends into said sealed diffusion chamber.

3. A muffler according claim 1, wherein:

said front closed end of said outlet pipe is made hemispherical.

4. A muffler according to claim 1, wherein:

said diffusion chamber is made cylindrical; and said muffler is constructed to satisfy the relation $$de \geqq (d-de)/2,$$

where de is the outside diameter of said outlet pipe, and d is the inside diameter of said diffusion chamber.

5. A muffler device according to claim 1, including:

an inlet pipe connected with said inlet port;

a muffler having an expansion chamber with a cross sectional area larger than that of said inlet pipe; and wherein said diffusion chamber is connected to communicate through said inlet pipe with said muffler provided with said expansion chamber.

6. A muffler device according to claim 5, wherein:

said expansion chamber is provided at least in one step at least on the up-stream side of said diffusion chamber.

7. A muffler device according to claim 5, wherein:

said expansion chamber includes a plurality of chambers communicating with one another, and provided up-stream of said diffusion chamber.

8. A muffler device for an internal combustion engine, comprising:

a sealed diffusion chamber having an inlet port through which exhaust from said engine is introduced into said sealed diffusion chamber;

an outlet pipe extending into said sealed diffusion chamber and communicating therewith through a plurality of perforations formed in said outlet pipe;

said outlet pipe having a front closed end disposed at a predetermined distance from and opposed to said inlet port;

said outlet pipe having a rear end communicating with the atmosphere;

said inlet port having a cross section that is smaller than the cross section of said sealed diffusion chamber;

an inlet pipe connected with said inlet port;

a muffler having an expansion chamber with a cross sectional area larger than that of said inlet pipe;

said diffusion chamber being connected to communicate through said inlet pipe with said muffler provided with said expansion chamber;

said expansion chamber including a plurality of chambers communicating with one another, and provided up-stream of said diffusion chamber;

said diffusion chamber being connected to communicate with said plurality of expansion chambers; and there being provided an intermediate detour chamber, communicating with the respective chambers, between the plurality of expansion chambers.

9. A muffler device according to claim 7, wherein:

said muffler including said diffusion chamber is fitted within the last stage of said expansion chambers.

10. A muffler device according to claim 7, wherein:

said expansion chamber (430*a*) communicating with said diffusion chamber, and an up-stream expansion chamber (430) are formed separately and are connected to communicate with each other through a connecting pipe (434).

11. A muffler device for an internal combustion engine, comprising:

a sealed diffusion chamber having an inlet port through which exhaust from said engine is introduced into said sealed diffusion chamber;

an outlet pipe extending into said sealed diffusion chamber and communicating therewith through a plurality of perforations formed in said outlet pipe;

said outlet pipe having a front closed end disposed at a predetermined distance from and opposed to said inlet port;

said outlet pipe having a rear end communicating with the atmosphere;

said inlet port having a cross section that is smaller than the cross section of said sealed diffusion chamber;

an inlet pipe connected with said inlet port;

a muffler having an expansion chamber with a cross sectional area larger than that of said inlet pipe;

said diffusion chamber being connected to communicate through said inlet pipe with said muffler provided with said expansion chamber;

said expansion chamber including a plurality of chambers communicating with one another, and provided up-stream of said diffusion chamber;

said expansion chamber (430*a*) communicating with said diffusion chamber, and an up-stream expansion chamber (430), being formed separately and being connected to communicate with each other through a connecting pipe (434); and said muffler (400*a*) including a secondary expansion chamber (430*c*), communicating with the muffler (401) including said diffusion chamber, and a primary expansion chamber (430*a*) formed around said secondary expansion chamber (430*c*) and connected to communicate with said up-stream expansion chamber (430) through a detour chamber (430*b*).

12. A muffler device according to claim 11, wherein:

the outer wall of said diffusion chamber is formed by a part of the case of said secondary expansion chamber (430*c*).

13. A muffler according to claim 5, wherein:

said expansion chamber (430*a*) is fitted on its inner wall with sound absorbing material (437*a*) through an inner wall member (436*a*) having many holes therein.

14. A muffler device for an internal combustion engine, comprising:

a sealed diffusion chamber having an inlet port through which exhaust from said engine is introduced into said sealed diffusion chamber;

an outlet pipe extending into said sealed diffusion chamber and communicating therewith through a plurality of perforations formed in said outlet pipe;

said outlet pipe having a front closed end disposed at a predetermined distance from and opposed to said inlet port;

said outlet pipe having a rear end communicating with the atmosphere;

said inlet port having a cross section that is smaller than the cross section of said sealed diffusion chamber;

at least two communicating pipes (51, 52) disposed within an expansion chamber (44*b*);

one (51) of said communicating pipes (51, 52) communicating at one end (51*c*) with the interior of said expansion chamber (44*b*);

the other communicating pipe (52) being extended at one end (52*c*) out of said expansion chamber (44*b*) to communicate with said inlet port of said diffusion chamber; and said communicating pipes (51, 52) being connected with each other at their other ends (51*b*, 52*b*) directed in the same direction through a curved passage (53) formed by a partition plate (47) having a part (47*a*) which is curved to be concave.

15. A muffler according to claim 14, wherein:

said partition plate (47) includes front and rear members (46, 48) between which said curved passage (53) is formed; and front and rear chambers (44*a*, 44*b*) sectioned from each other by said members (46, 48) are connected to communicate with each other through a pipe member (49) insulated from said curved passage (53).

16. A muffler according to claim 14, wherein:

said curved passage (53) is provided in a part of said partition plate (47) opposed to said other ends (51*b*, 52*b*) in the same direction of said communicating pipes (51, 52).

17. A muffler according to claim 14, wherein:

said communicating pipes (51, 52) are constructed so that said other ends (51*b*, 52*b*) present in said curved passage (53) have their openings facing each other.

18. A muffler according to claim 17, wherein:

said communicating pipes are cut diagonally at said ends present in said curved passage so as to have said openings face each other.

19. A muffler according to claim 2, wherein:

said diffusion chamber is provided on its front and rear end walls with ring-shaped flange parts having a diameter smaller than that of said inner wall of said diffusion chamber;

a cylindrical member having many small holes therein is inserted and supported between said flange parts; and sound absorbing material is disposed between said cylindrical member and said inner wall of said diffusion chamber.

20. A muffler device for an internal combustion engine, comprising:

a sealed diffusion chamber having an inlet port through which exhaust from said engine is introduced into said sealed diffusion chamber;

an outlet pipe extending into said sealed diffusion chamber and communicating therewith through a plurality of perforations formed in said outlet pipe;

said outlet pipe having a front closed end disposed at a predetermined distance from and opposed to said inlet port;

said outlet pipe having a rear end communicating with the atmosphere;

said inlet port having a cross section that is smaller than the cross section of said sealed diffusion chamber;

an inlet pipe connected with said inlet port;

a muffler having an expansion chamber with a cross sectional area larger than that of said inlet pipe;

said diffusion chamber being connected to communicate through said inlet pipe with said muffler provided with said expansion chamber;

partition plates having communicating pipes therethrough being disposed at the front and rear of a cylindrical body forming said expansion chamber, and being provided with supporting flange parts of a diameter smaller than the inside diameter of said cylindrical body;

a cylindrical pressing member having many small holes therein being inserted between said supporting flange parts; and sound absorbing material being placed between said pressing member and said cylindrical body.

21. A muffler device according to claim 20, wherein:

at least two of said partition plates are arranged at predetermined intervals in the axial direction of said cylindrical body;

pressing members are fitted in turn between the supporting flange parts of the respective partition plates;

sound absorbing material is fitted between each pressing member and the inside diameter part of said cylindrical body; and expansion chambers communicate with each other through said communicating pipes, sectioned with said partition plates, fitted on their inner walls with sound absorbing material, are formed in multisteps.

22. A muffler device according to claim 20, wherein:

a front partition plate is fitted and fixed within said cylindrical body;

said pressing member is fitted at its rear end in the flange part of the rear partition plate;

sound absorbing material is fitted to the outer periphery of said pressing member to form a unit;

said unit is fitted and inserted in said cylindrical body;

said pressing member is fitted at its front end in the flange part of said front partition plate; and said rear partition plate is fixed to said cylindrical body.

* * * * *